US006128591A

United States Patent [19]

Taori et al.

[11] Patent Number: 6,128,591

[45] Date of Patent: Oct. 3, 2000

[54] SPEECH ENCODING SYSTEM WITH INCREASED FREQUENCY OF DETERMINATION OF ANALYSIS COEFFICIENTS IN VICINITY OF TRANSITIONS BETWEEN VOICED AND UNVOICED SPEECH SEGMENTS

[75] Inventors: Rakesh Taori; Robert J. Sluijter; Andreas J. Gerrits, all of Eindhoven, Netherlands

[73] Assignee: U.S. Philips Corporation, New York, N.Y.

[21] Appl. No.: 09/114,746

[22] Filed: Jul. 13, 1998

[30] Foreign Application Priority Data

Jul. 11, 1997 [EP] European Pat. Off. ..... 97202166

[51] Int. Cl.[7] ..... G10L 11/06

[52] U.S. Cl. ..... 704/214; 704/211

[58] Field of Search ..... 704/208, 211, 704/213, 214

[56] References Cited

U.S. PATENT DOCUMENTS 4,797,926 1/1989 Bronson et al. ..... 704/214
5,197,113 3/1993 Mumolo ..... 704/200
5,680,507 10/1997 Chen ..... 704/223
5,696,873 12/1997 Bartkowiak ..... 704/216
5,724,480 3/1998 Yamaura ..... 704/219
5,734,789 3/1998 Swaminathan ..... 704/206
5,774,836 6/1998 Bartkowiak ..... 704/207
5,774,837 6/1998 Yeldener et al. ..... 704/208
5,828,996 10/1998 Iijima et al. ..... 704/220
5,848,387 12/1998 Nishiguchi et al. ..... 704/214
5,878,081 3/1999 Sluijter et al. ..... 375/242
5,884,253 3/1999 Kleijn ..... 704/223
5,897,615 4/1999 Harada ..... 704/214

*Primary Examiner*—Krista Zele
*Assistant Examiner*—Michael N. Opsasnick
*Attorney, Agent, or Firm*—Leroy Eason

[57] ABSTRACT

In a speech encoder (4), a speech signal is encoded using a voiced speech encoder (16) and an unvoiced speech encoder (14). Both speech encoders (14,16) use analysis coefficients to represent the speech signal. The analysis coefficients are determined more frequently when a transition from voiced to unvoiced speech or vice versa is detected. This has been found to achieve significantly improved quality of speech reproduced from the encoded speech signal.

12 Claims, 9 Drawing Sheets

SPEECH ENCODING SYSTEM WITH INCREASED FREQUENCY OF DETERMINATION OF ANALYSIS COEFFICIENTS IN VICINITY OF TRANSITIONS BETWEEN VOICED AND UNVOICED SPEECH SEGMENTS

BACKGROUND OF THE INVENTION

1. Field of the Invention

The present invention relates to a transmission system comprising a transmitter with a speech encoder comprising analysis means for periodically determining analysis coefficients from the speech signal. The transmitter also includes transmit means for transmitting said analysis coefficients via a transmission medium to a receiver, said receiver comprises a speech decoder with reconstruction means for deriving a reconstructed speech signal on the basis of the analysis coefficients.

The present invention also relates to a transmitter, a receiver, a speech encoder, a speech decoder, a speech encoding method, a speech decoding method, and a tangible medium comprising a computer program implementing said methods.

2. Description of the Related Art

A transmission system according to the preamble is known from EP 259 950.

Such transmission systems and speech encoders are used in applications in which speech signals are to be transmitted over a transmission medium with a limited transmission capacity or stored on storage media with a limited storage capacity. Examples of such applications are the transmission of speech signals over the Internet, the transmission of speech signals from a mobile phone to a base station and vice versa, and storage of speech signals on a CD-ROM, or in a solid state memory or on a hard disk drive.

Different operating principles of speech encoders have been tried to achieve a reasonable speech quality at a modest bit rate. In one of these operating methods, a distinction is made between voiced speech signals and unvoiced speech signals. These two kinds of speech signals are encoded using different speech encoders, each of them being optimized for the properties of the corresponding type of speech signals.

Another operating type is the so-called CELP encoder in which a speech signal is compared with a synthetic speech signal which is obtained by exciting a synthesis filter by an excitation signal derived form a plurality of excitation signals stored in a codebook. In order to deal with periodic signals such as voiced speech signals, a so-called adaptive codebook is used.

In both types of speech encoders, analysis parameters have to be determined to describe the speech signals. However, when the available bitrate for the speech encoder is decreased, the obtainable speech quality of the reconstructed speech deteriorates rapidly.

SUMMARY OF THE INVENTION

The object of the present invention is to provide a transmission system for speech signals in which the deterioration of the speech quality with decreased bitrate is reduced.

The transmission system according to the invention is characterized in that the analysis means are arranged for determining the analysis coefficients more frequently near a transition between a voiced speech segment and an unvoiced speech segment or vice versa, and in that the reconstruction means are arranged for deriving a reconstructed speech signal on the basis of the more frequently determined analysis coefficients.

The present invention is based on the recognition that an important source of deterioration of the quality of the speech signal is the insufficient tracking of changes in the analysis parameters during a transition from voiced speech to unvoiced speech or vice versa. By increasing the update rate of the analysis parameters near such a transition the speech quality is substantially improved. Because such transitions do not occur very often, the additional bitrate required to deal with the more frequent update of the analysis parameters is modest. It is observed that it is possible that the frequency of determining the analysis coefficients is increased before the transition actually takes place, but that it is also possible that the frequency of determining the analysis coefficients is increased after the transition takes place. A combination of the above way of increasing the frequency of determining the analysis coefficients is also possible.

An embodiment of the present invention is characterized in that the speech encoder comprises a voiced speech encoder for encoding voiced speech segments and an unvoiced speech encoder for encoding unvoiced speech segments.

Experiments have shown that the improvements that can be obtained by increasing the update rate of the analysis parameters near a transition is particularly advantageous for speech encoders using both a voiced and an unvoiced speech encoder. With such type of speech encoders the possible improvement is substantial.

A further embodiment of the invention is characterized in that the analysis means are arranged for determining the analysis coefficients more frequently for two segments subsequent to the transition. It has turned out that determining the analysis coefficients more frequently for two frames subsequently to the transition results in a substantially increased speech quality.

A still further embodiment of the invention is characterized in that the analysis means are arranged for doubling the frequency of the determination of analysis coefficients at a transition between a voiced and unvoiced segment or vice versa.

Doubling the frequency of the determination of the analysis coefficients has been proven sufficient to obtain a substantially increased speech quality.

BRIEF DESCRIPTION OF THE DRAWINGS

The present invention will now be explained with reference to the drawing figures. Showing.

DESCRIPTION OF THE PREFERRED EMBODIMENTS

Figure 1:
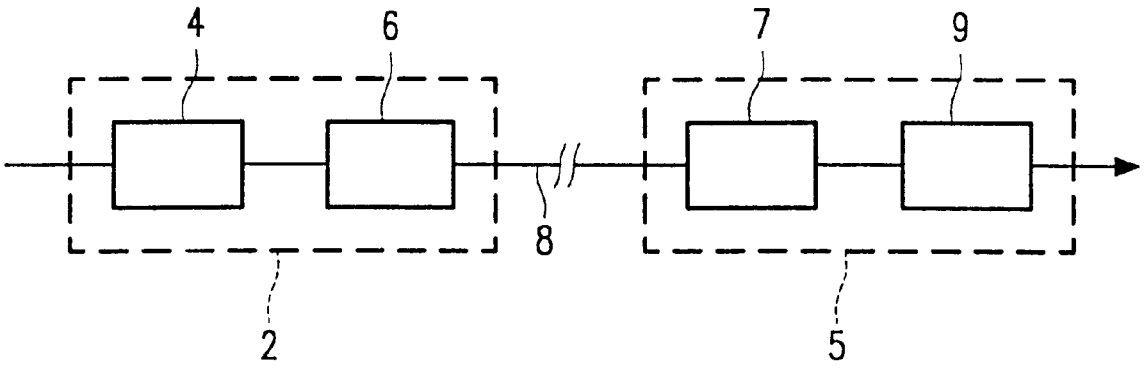
FIG. 1, a transmission system in which the present invention can be used.

In the transmission system according to FIG. 1, a speech signal is applied to an input of a transmitter 2. In the transmitter 2, the speech signal is encoded in a speech encoder 4. The encoded speech signal at the output of the speech encoder 4 is passed to transmit means 6. The transmit means 6 are arranged for performing channel coding, interleaving and modulation of the coded speech signal.

The output signal of the transmit means 6 is passed to the output of the transmitter, and is conveyed to a receiver 5 via a transmission medium 8. At the receiver 5, the output signal of the channel is passed to receive means 7. These receive means 7 provide RF processing, such as tuning and demodulation, de-interleaving (if applicable) and channel decoding. The output signal of the receive means 7 is passed to the speech decoder 9 which converts its input signal to a reconstructed speech signal.

Figure 2:
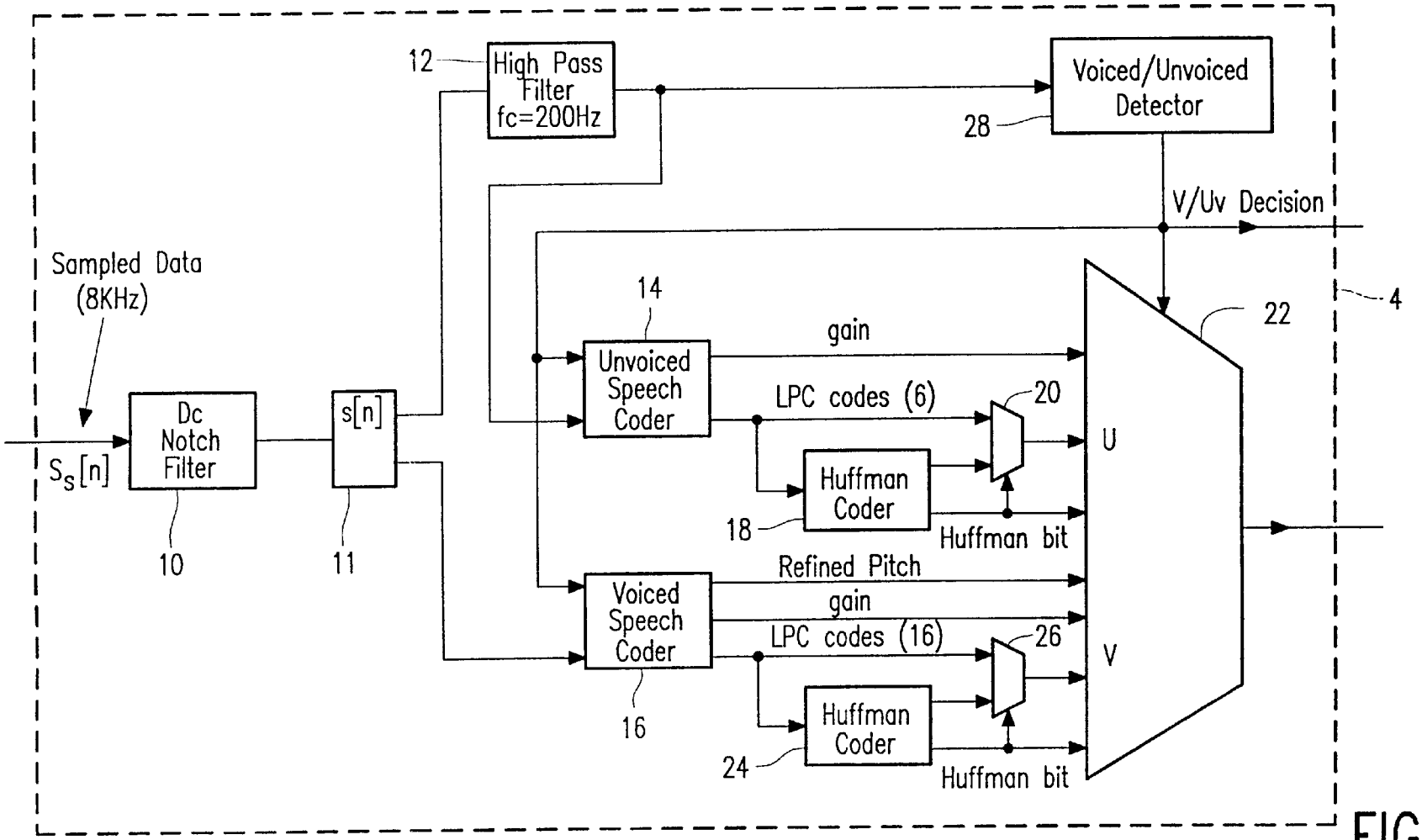
FIG. 2, a speech encoder 4 according to the invention.

The input signal $s_s[n]$ of the speech encoder 4 according to FIG. 2, is filtered by a DC notch filter 10 to eliminate undesired DC offsets from the input. Said DC notch filter has a cut-off frequency (−3 dB) of 15 Hz. The output signal of the DC notch filter 10 is applied to an input of a buffer 11. The buffer 11 presents blocks of 400 DC filtered speech samples to a voiced speech encoder 16 according to the invention. Said block of 400 samples comprises 5 frames of 10 ms of speech (each 80 samples). It comprises the frame presently to be encoded, two preceding and two subsequent frames. The buffer 11 presents in each frame interval the most recently received frame of 80 samples to an input of a 200 Hz high pass filter 12. The output of the high pass filter 12 is connected to an input of a unvoiced speech encoder 14 and to an input of a voiced/unvoiced detector 28. The high pass filter 12 provides blocks of 360 samples to the voiced/unvoiced detector 28 and blocks of 160 samples (if the speech encoder 4 operates in a 5.2 kbit/sec mode) or 240 samples (if the speech encoder 4 operates in a 3.2 kbit/sec mode) to the unvoiced speech encoder 14. The relation between the different blocks of samples presented above and the output of the buffer 11 is presented in the table below.

| | Element | | | |
|---|---|---|---|---|
| | 5.2 kbit/sec | | 3.2 kbit/s | |
| | #samples | start | #samples | start |
| high pass filter 12 | 80 | 320 | 80 | 320 |
| voiced/unvoiced detector 28 | 360 | 0 . . . 40 | 360 | 0 . . . 40 |
| voiced speech encoder 16 | 400 | 0 | 400 | 0 |
| unvoiced speech encoder 14 | 160 | 120 | 240 | 120 |
| present frame to be encoded | 80 | 160 | 80 | 160 |

The voiced/unvoiced detector 28 determines whether the current frame comprises voiced or unvoiced speech, and presents the result as a voiced/unvoiced flag. This flag is passed to a multiplexer 22, to the unvoiced speech encoder 14 and the voiced speech encoder 16. Dependent on the value of the voiced/unvoiced flag, the voiced speech encoder 16 or the unvoiced speech encoder 14 is activated.

In the voiced speech encoder 16 the input signal is represented as a plurality of harmonically related sinusoidal signals. The output of the voiced speech encoder provides a pitch value, a gain value and a representation of 16 prediction parameters. The pitch value and the gain value are applied to corresponding inputs of a multiplexer 22.

In the 5.2 kbit/sec mode the LPC computation is performed every 10 ms. In the 3.2 kbit/sec the LPC computation is performed every 20 ms, except when a transition between unvoiced to voiced speech or vice versa takes place. If such a transition occurs, in the 3.2 kbit/sec mode the LPC calculation is also performed every 10 msec.

The LPC coefficients at the output of the voiced speech encoder are encoded by a Huffman encoder 24. The length of the Huffman encoded sequence is compared with the length of the corresponding input sequence by a comparator in the Huffman encoder 24. If the length of the Huffman encoded sequence is longer than the input sequence, it is decided to transmit the uncoded sequence. Otherwise it is decided to transmit the Huffman encoded sequence. Said decision is represented by a "Huffman bit" which is applied to a multiplexer 26 and to a multiplexer 22. The multiplexer 26 is arranged to pass the Huffman encoded sequence or the input sequence to the multiplexer 22 in dependence on the value of the "Huffinan Bit". The use of the "Huffinan bit" in combination with the multiplexer 26 has the advantage that it is ensured that the length of the representation of the prediction coefficients does not exceed a predetermined value. Without the use of the "Huffman bit" and the multiplexer 26 it could happen that the length of the Huffman encoded sequence exceeds the length of the input sequence to such an extent that the encoded sequence does not fit anymore in the transmit frame in which a limited number of bits are reserved for the transmission of the LPC coefficients.

In the unvoiced speech encoder 14 a gain value and 6 prediction coefficients are determined to represent the unvoiced speech signal. The 6 LPC coefficients are encoded by a Huffman encoder 18 which presents at its output a Huffman encoded sequence and a "Huffman bit". The Huffman encoded sequence and the input sequence of the Huffman encoder 18 are applied to a multiplexer 20 which is controlled by the "Huffman bit". The operation of the combination of the Huffman encoder 18 and the multiplexer 20 is the same as the operation of the Huffman encoder 24 and the multiplexer 20.

The output signal of the multiplexer 20 and the "Huffman bit" are applied to corresponding inputs of the multiplexer 22. The multiplexer 22 is arranged for selecting the encoded voiced speech signal or the encoded unvoiced speech signal, dependent on the decision of the voiced-unvoiced detector 28. At the output of the multiplexer 22 the encoded speech signal is available.

Figure 3:
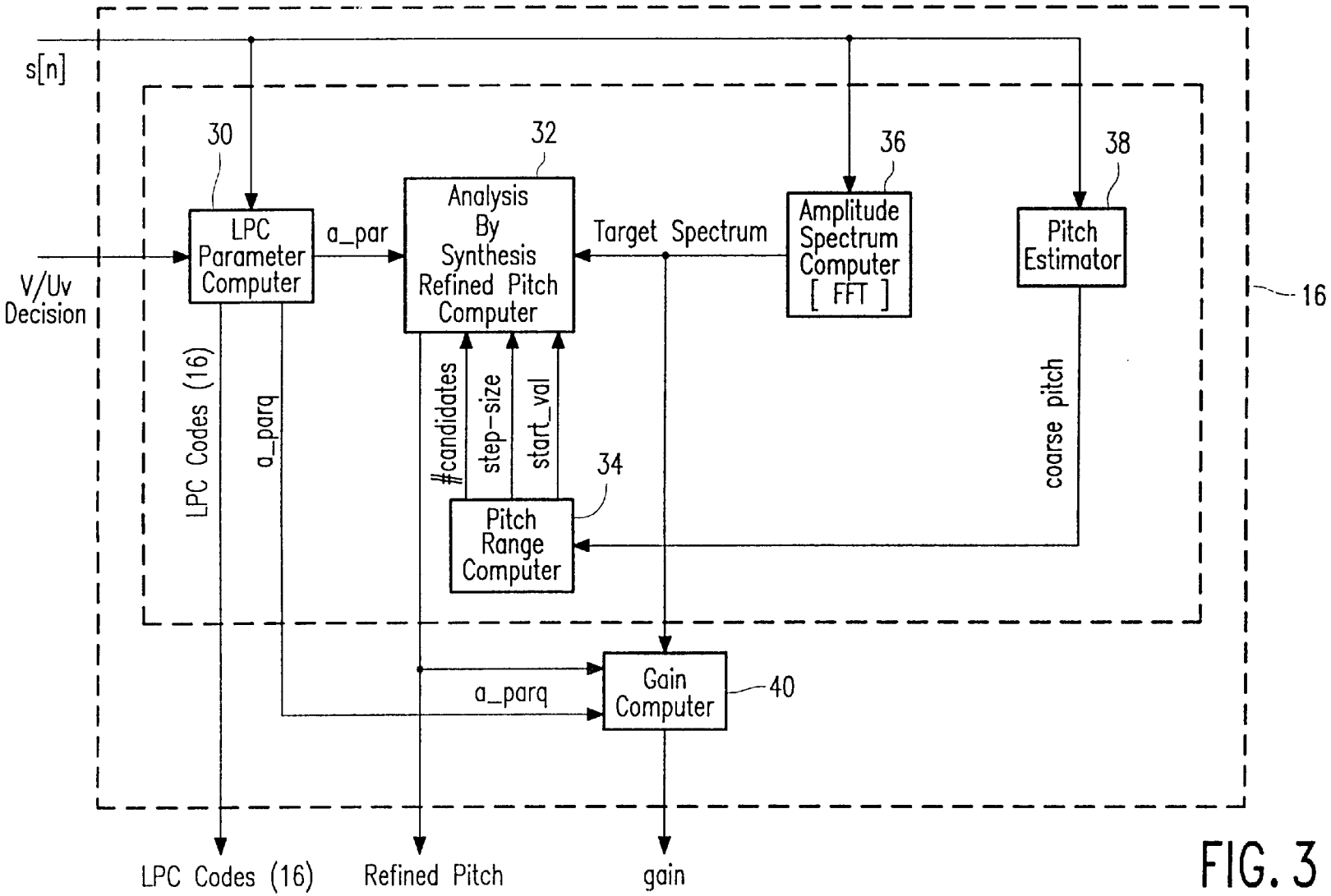
FIG. 3, a voiced speech encoder 16 according to the present invention.

In the voiced speech encoder 16 according to FIG. 3, the analysis means according to the invention are constituted by the LPC Parameter Computer 30, the Refined Pitch Computer 32 and the Pitch Estimator 38. The speech signal s[n] is applied to an input of the LPC Parameter Computer 30. The LPC Parameter Computer 30 determines the prediction coefficients a[i], the quantized prediction coefficients aq[i] obtained after quantizing, coding and decoding a[i], and LPC codes C[i], in which i can have values from 0–15.

The pitch determination means according to the inventive concept comprise initial pitch determining means, being here a pitch estimator 38, and pitch tuning means, being here a Pitch Range Computer 34 and a Refined Pitch Computer 32. The pitch estimator 38 determines a coarse pitch value which is used in the pitch range computer 34 for determining the pitch values which are to be tried in the pitch tuning means further to be referred to as Refined Pitch Computer 32 for determining the final pitch value. The pitch estimator 38 provides a coarse pitch period expressed in a number of samples. The pitch values to be used in the Refined Pitch Computer 32 are determined by the pitch range computer 34 from the coarse pitch period according to the table below.

| Coarse pitch period p | Frequency (Hz) | Search Range | step-size | #candidates |
|---|---|---|---|---|
| 20 ≦ p ≦ 39 | 400 . . . 200 | p−3 . . . p+3 | 0.25 | 24 |
| 40 ≦ p ≦ 79 | 200 . . . 100 | p−2 . . . p+2 | 0.25 | 16 |
| 80 ≦ p ≦ 200 | 100 . . . 40 | p | 1 | 1 |

In the amplitude spectrum computer 36 a windowed speech signal $S_{HAM}$ is determined from the signal s[i] according to:

$$S_{HAM}[i-120]=w_{HAM}[i]\cdot s[i] \tag{1}$$

In (1) $w_{HAM}[i]$ is equal to:

$$w_{HAM} = 0.54 - 0.46\cos\left\{\frac{2\pi((i+0.5)-120)}{160}\right\};\ 120 \le i < 280 \tag{2}$$

The windowed speech signal $s_{HAM}[i]$ is transformed to the frequency domain using a 512 point FFT. The spectrum $S_w$ obtained by said transformation is equal to:

$$S_w[k] = \sum_{m=0}^{159} s_{HAM}[m]\cdot e^{-j2\pi km/512} \tag{3}$$

The amplitude spectrum to be used in the Refined Pitch Computer 32 is calculated according to:

$$|S_w[k]|=\sqrt{(\Re\{S_{w[k]}\})^2+(\Im\{S_{w[k]}\})^2} \tag{4}$$

The Refined Pitch Computer 32 determines from the a-parameters provided by the LPC Parameter Computer 30 and the coarse pitch value a refined pitch value which results in a minimum error signal between the amplitude spectrum according to (4) and the amplitude spectrum of a signal comprising a plurality of harmonically related sinusoidal signals of which the amplitudes have been determined by sampling the LPC spectrum by said refined pitch period.

In the gain computer 40 the optimum gain to match the target spectrum accurately is calculated from the spectrum of the re-synthesized speech signal using the quantized a-parameters, instead of using the non-quantized a-parameters as is done in the Refined Pitch Computer 32.

At the output of the voiced speech encoder 16 the 16 LPC codes, the refined pitch and the gain calculated by the Gain Computer 40 are available. The operation of the LPC parameter computer 30 and the Refined Pitch Computer 32 are explained below in more detail.

Figure 4:
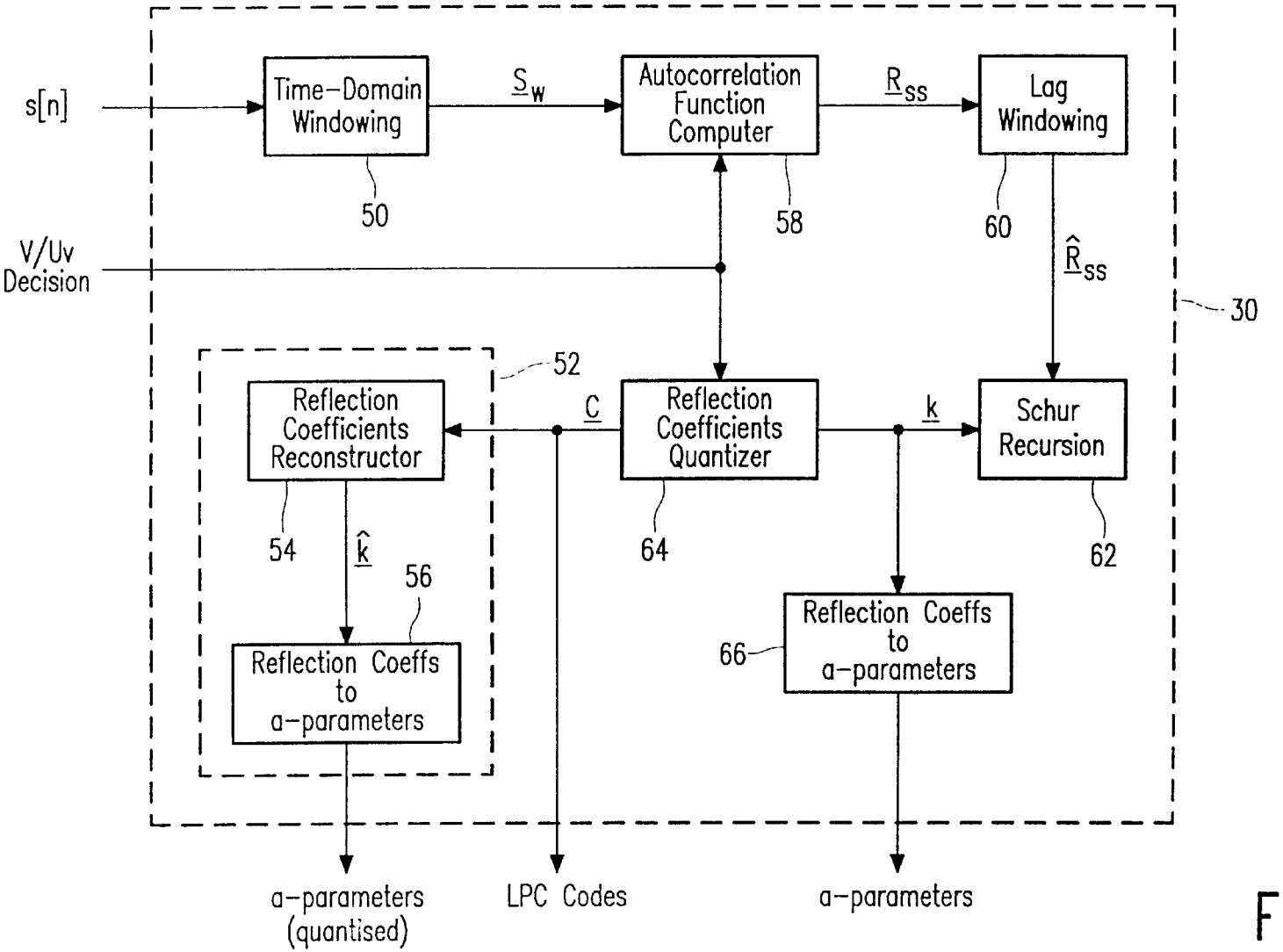
FIG. 4, LPC computation means 30 for use in the voiced speech encoder 16 according to FIG. 3.

In the LPC computer 30 according to FIG. 4, a window operation is performed on the signal s[n] by a window processor 50. According to one aspect of the present invention, the analysis length is dependent on the value of the voiced/unvoiced flag. In the 5.2 kbit/sec mode, the LPC computation is performed every 10 msec. In the 3.2 kbit/sec mode, the LPC calculation is performed every 20 msec, except during transitions from voiced to unvoiced or vice versa. If such a transition is present, the LPC calculation is performed every 10 msec.

In the following table the number of samples involved with the determination of the prediction coefficients are given.

| Bit Rate and Mode | Analysis length $N_A$ and samples involved | Update interval |
|---|---|---|
| 5.2 kbit/s | 160 (120–280) | 10 ms |
| 3.2 kbit/s (transition) | 160 (120–280) | 10 ms |
| 3.2 kbit/s (no transition) | 240 (120–360) | 20 ms |

For the window in the 5.2 kbit/sec case and in the 3.2 kbit/s case where a transition is present, can be written:

$$w_{HAM} = 0.54 - 0.46\cos\left\{\frac{2\pi((i+0.5)-120)}{160}\right\};\ 120 \le i < 280 \tag{5}$$

For the windowed speech signal is found:

$$s_{HAM}[i-120]=w_{HAM}[i]\cdot s[i];\ 120\le i<280 \tag{6}$$

If in the 3.2 kbit/s case no transition is present, a flat top portion of 80 samples is introduced in the middle of the window thereby extending the window to span 240 samples starting at sample 120 and ending before sample 360. In this way a window $w'_{HAM}$ is obtained according to:

$$w'_{HAM} = \begin{cases} w_{HAM}[i]; & 120 \le i < 200 \\ 1; & 200 \le i < 280 \\ w_{HAM}[i]; & 280 \le i < 360 \end{cases} \tag{7}$$

for the windowed speech signal the following can be written.

$$s_{HAM}[i-120]=w_{HAM}[i]\cdot s[i];\ 120\le i<360 \tag{8}$$

The Autocorrelation Function Computer 58 determines the autocorrelation function $R_{ss}$ of the windowed speech signal. The number of correlation coefficients to be calculated is equal to the number of prediction coefficients +1. If a voiced speech frame is present, the number of autocorrelation coefficients to be calculated is 17. If an unvoiced speech frame is present, the number of autocorrelation coefficients to be calculated is 7. The presence of a voiced or unvoiced speech frame is signaled to the Autocorrelation Function Computer 58 by the voiced/unvoiced flag.

The autocorrelation coefficients are windowed with a so-called lag-window in order to obtain some spectral smoothing of the spectrum represented by said autocorrelation coefficients. The smoothed autocorrelation coefficients ρ[i] are calculated according to:

$$\rho[i] = R_{SS}[i] \cdot \exp\left(\frac{-\pi f_\mu i}{8000}\right); 0 \le i \le P \quad (9)$$

In (9) $f_\mu$ is the spectral smoothing constant having a value of 46.4 Hz. The windowed autocorrelation values ρ[i] are passed to the Schur recursion module 62 which calculates the reflection coefficients k[1] to k[P] in a recursive way. The Schur recursion is well known to those skilled in the art.

In a converter 66 the P reflection coefficients ρ[i] are transformed into a-parameters for use in the Refined Pitch Computer 32 in FIG. 3. In a quantizer 64 the reflection coefficients are converted into Log Area Ratios, and these Log Area Ratios are subsequently uniformly quantized. The resulting LPC codes C[1] . . . C[P] are passed to the output of the LPC parameter computer for further transmission.

In the local decoder 54 the LPC codes C[1] . . . C[P] are converted into reconstructed reflection coefficients $\hat{k}[i]$ by a reflection coefficient reconstructor 54. Subsequently the reconstructed reflection coefficients $\hat{k}[i]$ are converted into (quantized) a-parameters by the Reflection Coefficient to a-parameter converter 56.

This local decoding is performed in order to have the same a-parameters available in the speech encoder 4 and the speech decoder 14.

Figure 5:
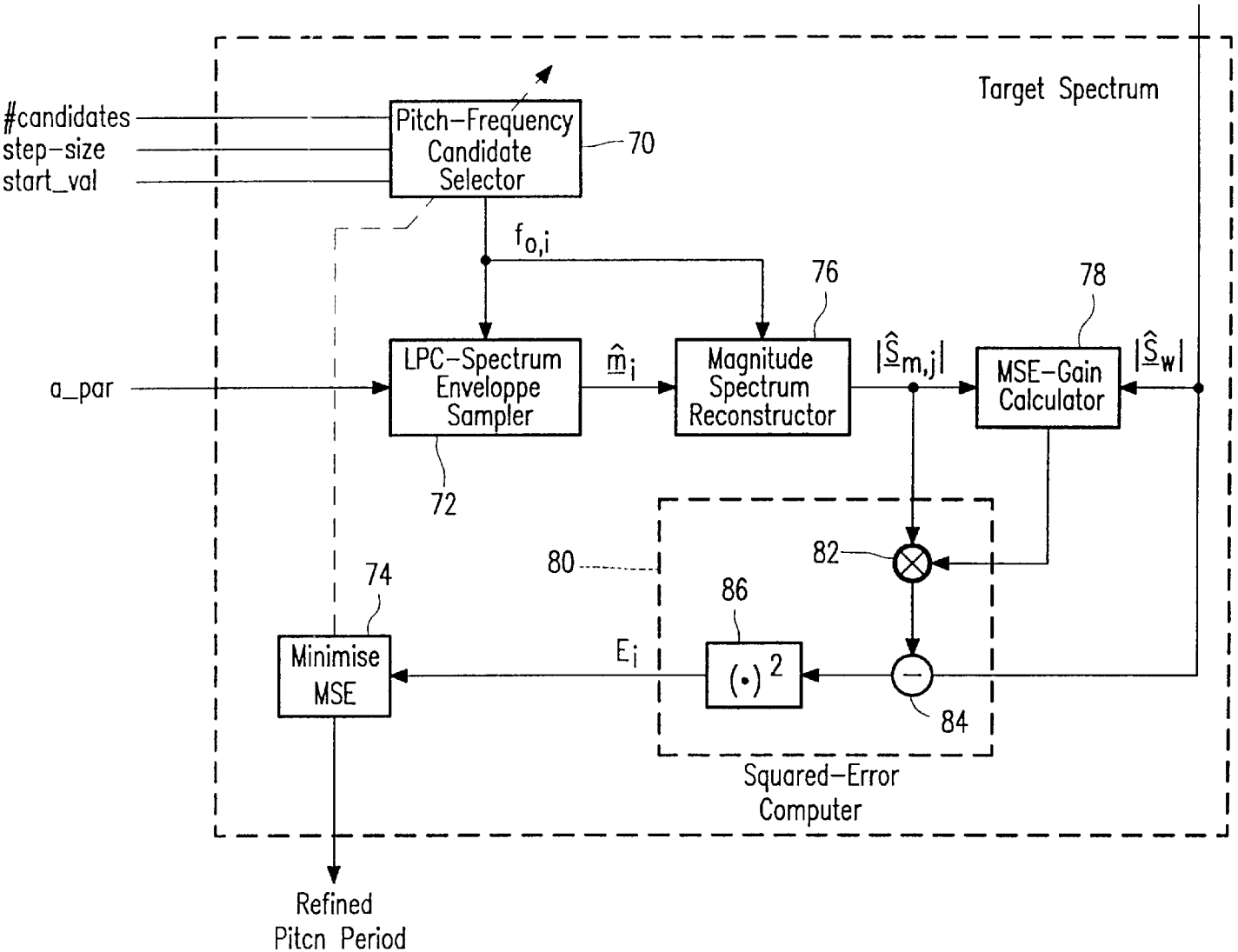
FIG. 5, pitch tuning means 32 for use in the speech encoder according to FIG. 3.

In the Refined Pitch Computer 32 according to FIG. 5, a Pitch Frequency Candidate Selector 70 determines from the number of candidates, the start value and the step size as received from the Pitch Range Computer 34 the candidate pitch values to be used in the Refined Pitch Computer 32. For each of the candidates, the Pitch Frequency Candidate Selector 70 determines a fundamental frequency $f_{0,i}$.

Using the candidate frequency $f_{0,i}$ the spectral envelope described by the LPC coefficients is sampled at harmonic locations by the Spectrum Envelope Sampler 72. For $m_{i,k}$ being the amplitude of the $k^{th}$ harmonic of the $i^{th}$ candidate $f_{0,i}$ can be written:

$$m_{i,k} = \left|\frac{1}{A(z)}\right|_{z=2\pi k \cdot f_{0,i}} \quad (10)$$

In (10), A(z) is equal to:

$$A(z)=1+a_1 \cdot z^{-1}+a_2 \cdot z^{-2}+\ldots+a_p \cdot z^{-P} \quad (11)$$

With $z=e^{j\theta_{i,k}}=\cos\theta_{i,k}+j\cdot\sin\theta_{i,k}$ and $\theta_{i,k}=2\pi k f_{0,i}$ (11) changes into:

$$A(z)|_{\theta=\theta_{i,k}}=1+a_1(\cos\theta_{i,k}+j\cdot\sin\theta_{i,k})+\ldots+a_p(\cos\theta_{P,k}+j\cdot\sin\theta_{P,k}) \quad (12)$$

By splitting (12) into real and imaginary parts, the amplitudes $m_{i,k}$ can be obtained according to:

$$m_{i,k} = \frac{1}{\sqrt{R^2(\theta_{i,k}) + I^2(\theta_{i,k})}} \quad (13)$$

where $$R(\theta_{i,k})=1+a_1(\cos\theta_{i,k})+\ldots+a_p(\cos\theta_{i,k}) \quad (14)$$

and $$I(\theta_{i,k})=1+a_1(\sin\theta_{i,k})+\ldots+a_p(\sin\theta_{i,k}) \quad (15)$$

The candidate spectrum $|\hat{S}_{w,i}|$ is determined by convolving the spectral lines $m_{i,k}$ ($1 \leqq k \leqq L$) with a spectral window function W which is the 8192 point FFT of the 160 points Hamming window according to (5) or (7), dependent on the current operating mode of the encoder. It is observed that the 8192 points FFT can be pre-calculated and that the result can be stored in ROM. In the convolving process a downsampling operation is performed because the candidate spectrum has to be compared with 256 points of the reference spectrum, making calculation of more than 256 points useless. Consequently for $|\hat{S}_{w,i}|$ can be written:

$$|\hat{S}_{w,i}[f]| = \sum_{k=1}^{L} m_{i,k} \cdot W(16 \cdot f - k \cdot f_{0,i}); 0 \le f < 256 \quad (16)$$

Expression (16) gives only the general shape of the amplitude spectrum for pitch candidate i, but not its amplitude. Consequently the spectrum $|\hat{S}_{w,i}|$ has to be corrected by a gain factor $g_i$ which is calculated by a MSE-gain Calculator 78 according to:

$$g_i = \frac{\sum_{j=0}^{256} S_w[j] \cdot \hat{S}_{w,i}[j]}{\sum_{j=0}^{256} (S_w[j])^2} \quad (17)$$

A multiplier 82 is arranged for scaling the spectrum $|\hat{S}_{w,i}|$ with the gain factor $g_i$. A subtracter 84 computes the difference between the coefficients of the target spectrum as determined by the Amplitude Spectrum Computer 36 and the output signal of the multiplier 82. Subsequently a summing squarer computes a squared error signal $E_i$ according to:

$$E_i = E(f_{0,i}) = \sum_{j=0}^{255} \left(|S_w[j]| - g_i \cdot |\hat{S}_{w,i}[j]|\right)^2 \quad (18)$$

The candidate fundamental frequency, $f_{0,i}$ that results in the minimum value is selected as the refined fundamental frequency or refined pitch. In the encoder according to the present example, a total of 368 pitch periods are possible requiring 9 bits for encoding. The pitch is updated every 10 msec independent of the mode of the speech encoder. In the gain calculator 40 according to FIG. 3, the gain to be transmitted to the decoder is calculated in the same way as is described above with respect to the gain $g_i$, but now the quantized a-parameters are used instead of the unquantized a-parameters which are used when calculating the gain $g_i$. The gain factor to be transmitted to the decoder is non-linearly quantized in 6 bits, such that for small values of $g_i$ small quantization steps are used, and for larger values of $g_i$ larger quantization steps are used.

Figure 6:
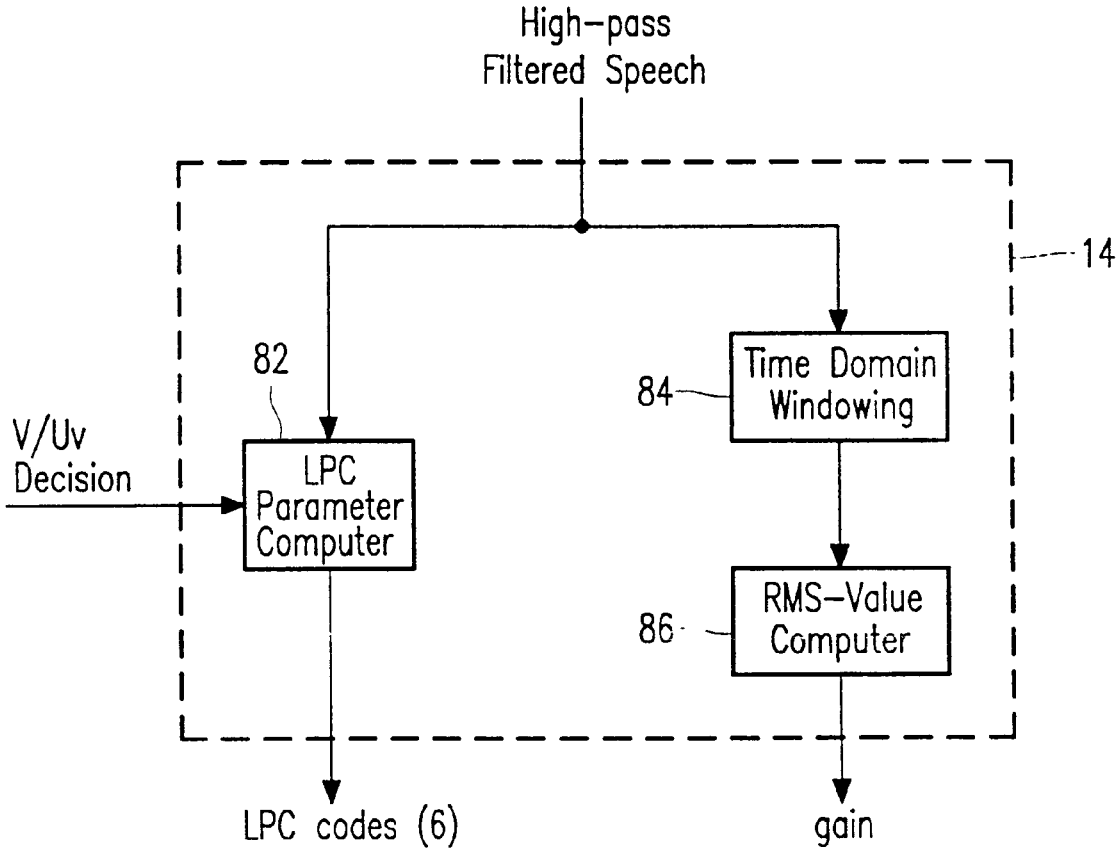
FIG. 6, an speech encoder 14 for unvoiced speech, for use in the speech encoder according to FIG. 2.

In the unvoiced speech encoder 14 according to FIG. 6, the operation of the LPC parameter computer 82 is similar to the operation of the LPC parameter computer 30 according to FIG. 4. The LPC parameter computer 82 operates on the high pass filtered speech signal instead of on the original speech signal as in done by the LPC parameter computer 30. Further the prediction order of the LPC computer 82 is 6 instead of 16 as is used in the LPC parameter pitch computer 30.

The time domain window processor 84 calculates a Hanning windowed speech signal according to:

$$s_w[n] = s[n] \cdot \left(0.5 - 0.5\cos\left(\frac{2 \cdot \pi(i + 0.5) - 120)}{160}\right)\right); \quad (19)$$

$$120 \le i < 280$$

In an RMS value computer 86 an average value $g_{uv}$ of the amplitude of a speech frame is calculated according to:

$$g_{uv} = \frac{1}{4}\sqrt{\frac{1}{N}\sum_{i=0}^{159} s_w^2[i]} \quad (20)$$

The gain factor $g_{uv}$ to be transmitted to the decoder is non-linearly quantized in 5 bits, such that for small values of $g_{uv}$ small quantization steps are used, and for larger values of $g_{uv}$ larger quantization steps are used. No excitation parameters are determined by the unvoiced speech encoder 14.

Figure 7:
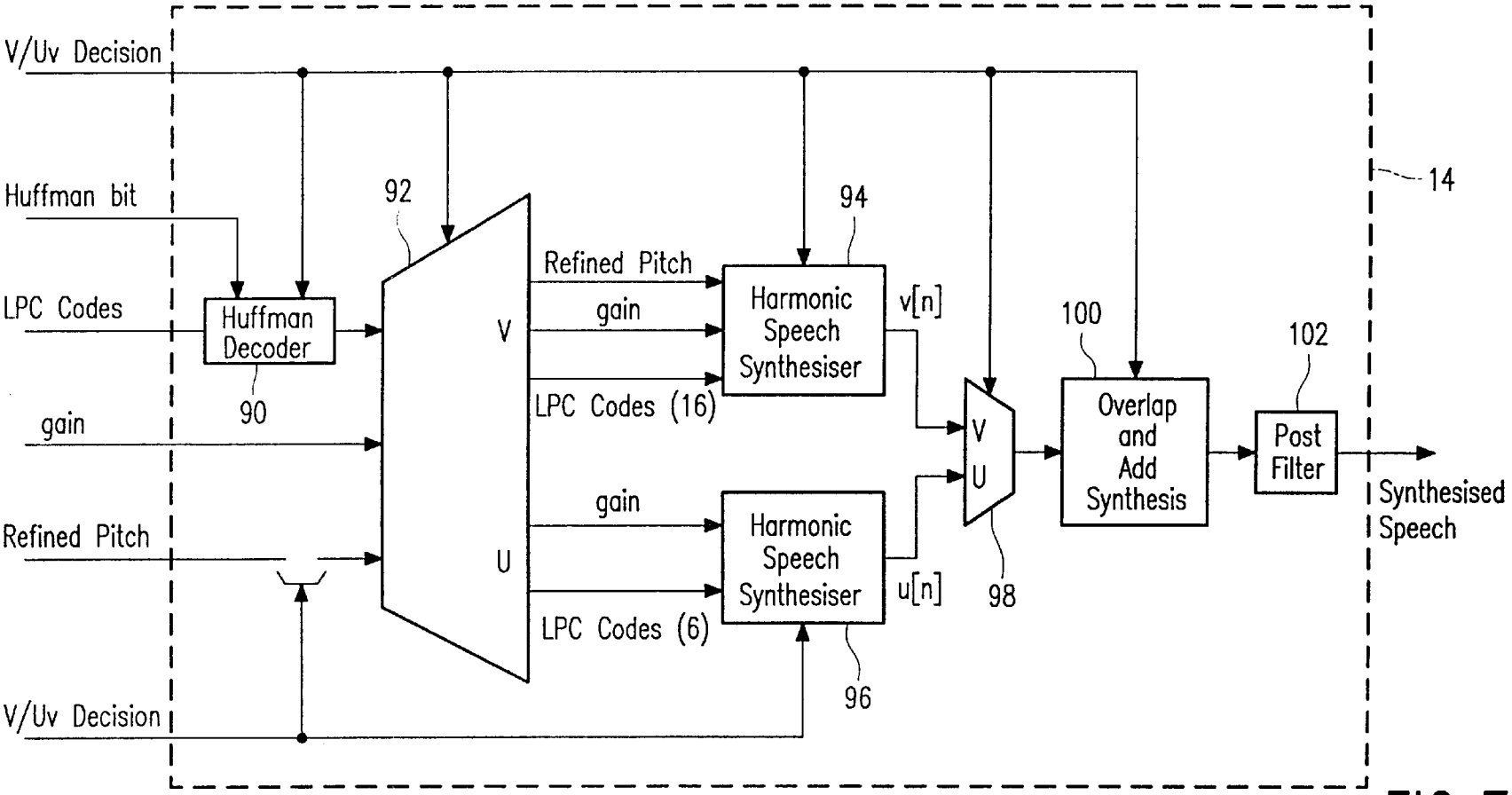
FIG. 7, a speech decoder 14 for use in the system according to FIG. 1.

In the speech decoder 14 according to FIG. 7, the Huffman encoded LPC codes and a voiced/unvoiced flag are applied to a Huffman decoder 90. The Huffman decoder 90 is arranged for decoding the Huffman encoded LPC codes according to the Huffman table used by the Huffman encoder 18 if the voiced/unvoiced flag indicates an unvoiced signal. The Huffman decoder 90 is arranged for decoding the Huffman encoded LPC codes according to the Huffman table used by the Huffman encoder 24 if the voiced/unvoiced flag indicates a voiced signal. In dependence on the value of the Huffman bit, the received LPC codes are decoded by the Huffman decoder 90 or passed directly to a demultiplexer 92. The gain value and the received refined pitch value are also passed to the demultiplexer 92.

If the voiced/unvoiced flag indicates a voiced speech frame, the refined pitch, the gain and the 16 LPC codes are passed to a harmonic speech synthesizer 94. If the voiced/unvoiced flag indicates an unvoiced speech frame, the gain and the 6 LPC codes are passed to an unvoiced speech synthesizer 96. The synthesized voiced speech signal $\hat{s}_{v,k}[n]$ at the output of the harmonic speech synthesizer 94 and the synthesized unvoiced speech signal $\hat{s}_{uv,k}[n]$ at the output of the unvoiced speech synthesizer 96 are applied to corresponding inputs of a multiplexer 98.

In the voiced mode, the multiplexer 98 passes the output signal $\hat{s}_{v,k}[n]$ of the Harmonic Speech Synthesizer 94 to the input of the Overlap and Add Synthesis block 100. In the unvoiced mode, the multiplexer 98 passes the output signal $\hat{s}_{uv,k}[n]$ of the Unvoiced Speech Synthesizer 96 to the input of the Overlap and Add Synthesis block 100. In the Overlap and Add Synthesis block 100, partly overlapping voiced and unvoiced speech segments are added. For the output signal $\hat{s}[n]$ of the Overlap and Add Synthesis Block 100 can be written:

$$\hat{s}[n] = \begin{cases} \hat{s}_{uv,k-1}[n + N_s/2] + \hat{s}_{uv,k}[n]; & v_{k-1} = 0, v_k = 0 \\ \hat{s}_{uv,k-1}[n + N_s/2] + \hat{s}_{v,k}[n]; & v_{k-1} = 0, v_k = 1 \\ \hat{s}_{v,k-1}[n + N_s/2] + \hat{s}_{uv,k}[n]; & v_{k-1} = 1, v_k = 0 \\ \hat{s}_{v,k-1}[n + N_s/2] + \hat{s}_{v,k}[n]; & v_{k-1} = 1, v_k = 1 \end{cases}$$

In (21) $N_S$ is the length of the speech frame, $v_{k-1}$ is the voiced/unvoiced flag for the previous speech frame, and $v_k$ is the voiced/unvoiced flag for the current speech frame.

The output signal $\hat{s}[n]$ of the Overlap and Block is applied to a postfilter 102. The postfilter is arranged for enhancing the perceived speech quality by suppressing noise outside the formant regions.

Figure 8:
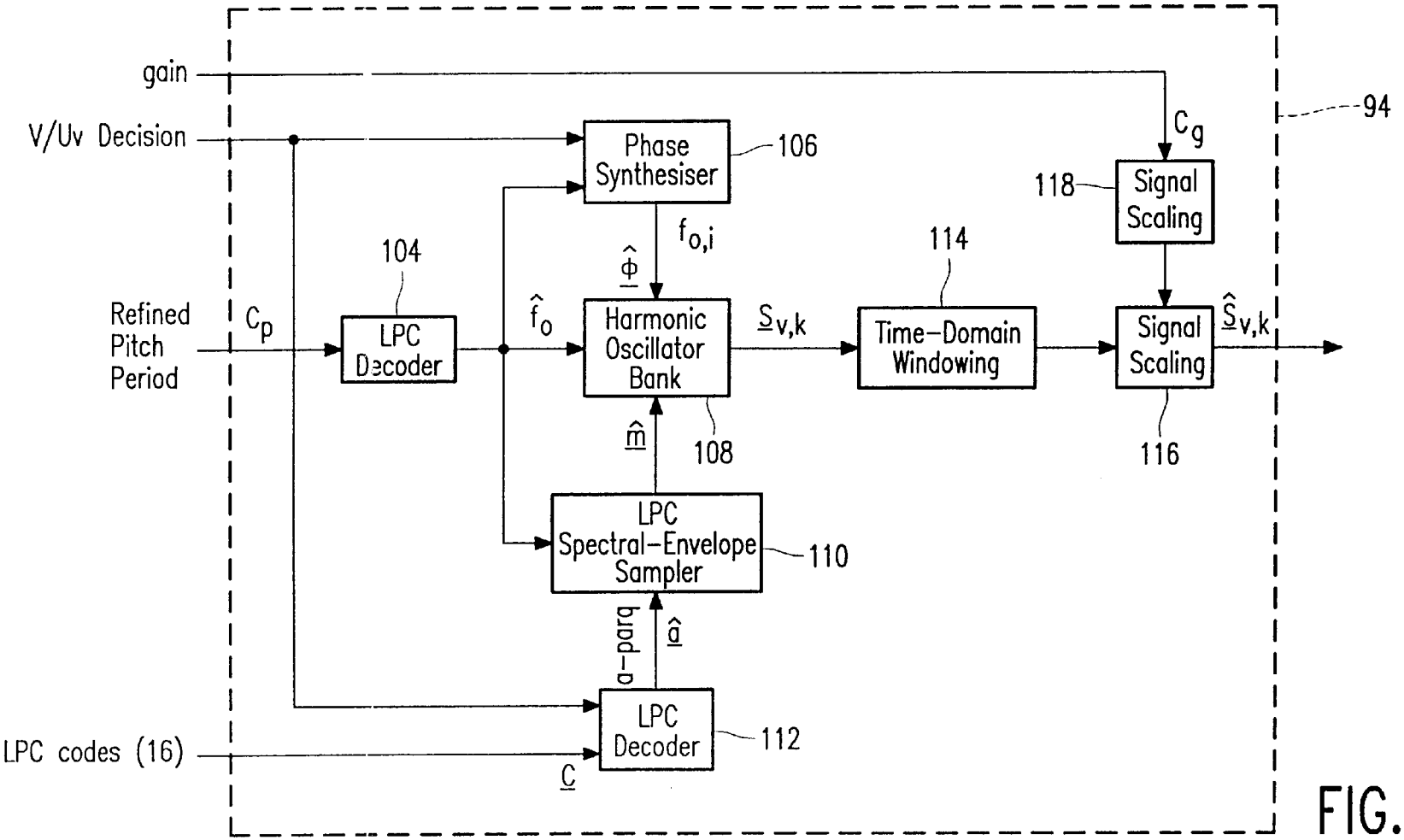
FIG. 8, a voiced speech decoder 94 for use in the speech decoder 14.

In the voiced speech decoder 94 according to FIG. 8, the encoded pitch received from the demultiplexer 92 is decoded and converted into a pitch period by a pitch decoder 104. The pitch period determined by the pitch decoder 104 is applied to an input of a phase synthesizer 106, to an input of a Harmonic Oscillator Bank 108 and to a first input of a LPC Spectrum Envelope Sampler 110.

The LPC coefficients received from the demultiplexer 92 is decoded by the LPC decoder 112. The way of decoding the LPC coefficients depends on whether the current speech frame contains voiced or unvoiced speech. Therefore the voiced/unvoiced flag is applied to a second input of the LPC decoder 112. The LPC decoder passes the quantized a-parameters to a second input of the LPC Spectrum envelope sampler 110. The operation of the LPC Spectral Envelope Sampler 112 is described by (13), (14) and (15) because the same operation is performed in the Refined Pitch Computer 32.

Figure 9:
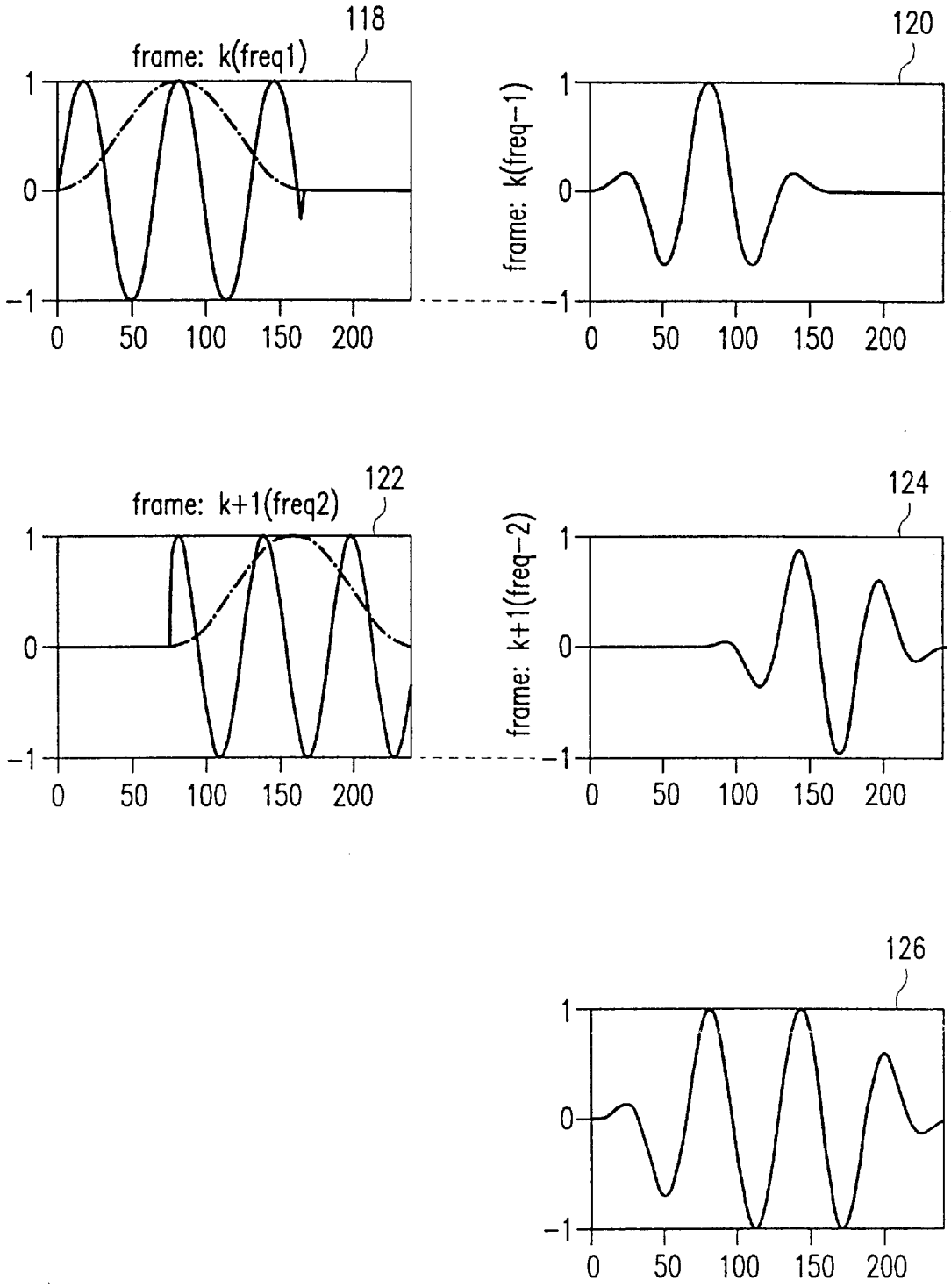
FIG. 9, graphs of signals present at a number of points in the voiced speech decoder 94.
Figure 10:
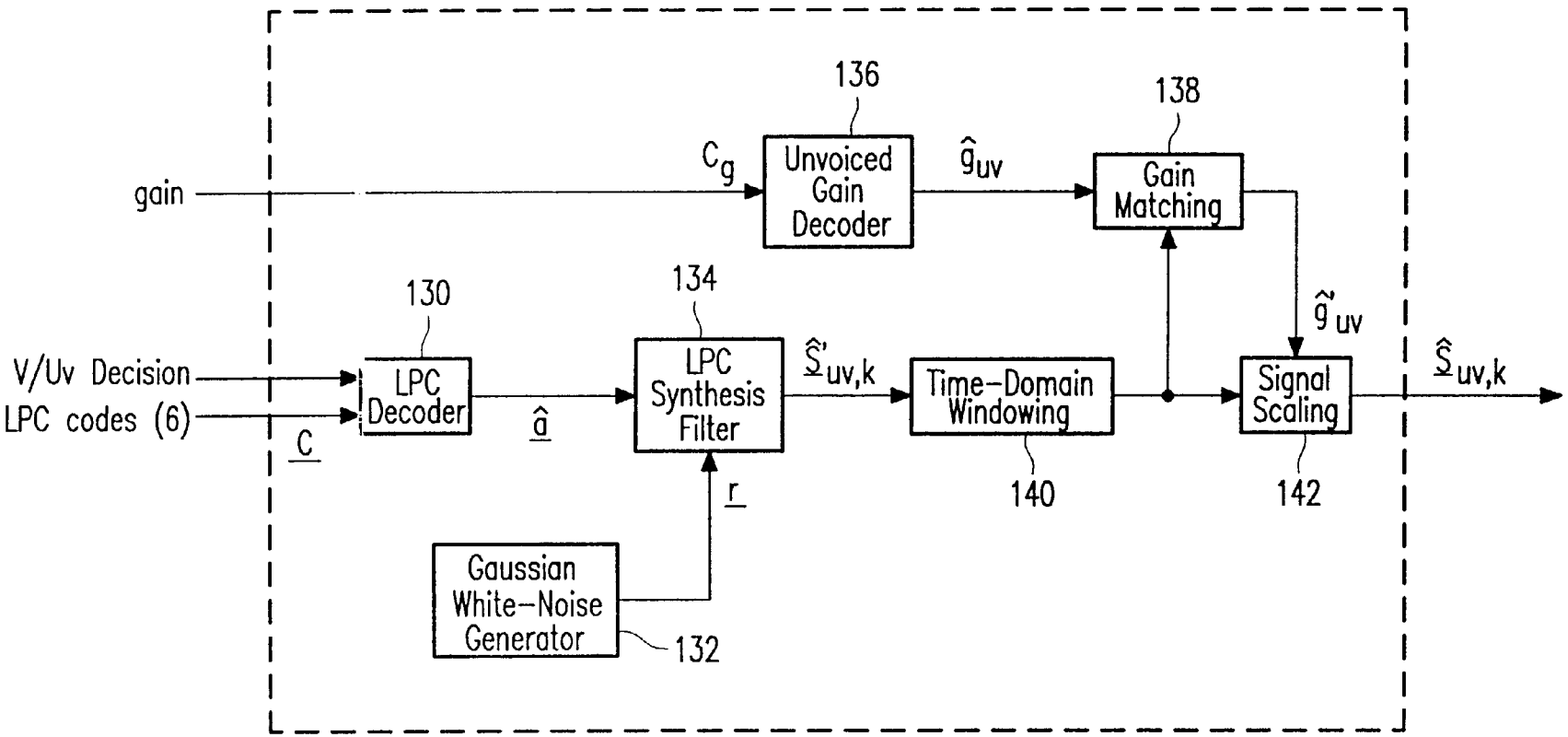
FIG. 10, an unvoiced speech decoder 96 for use in the speech decoder 14.

The phase synthesizer 106 is arranged to calculate the phase $\phi_k[i]$ of the $i^{th}$ sinusoidal signal of the L signals representing the speech signal. The phase $\phi_k[i]$ is chosen such that the $i^{th}$ sinusoidal signal remains continuous from one frame to a next frame. The voiced speech signal is synthesized by combining overlapping frames, each comprising 160 windowed samples. There is a 50% overlap between two adjacent frames as can be seen from graph 118 and graph 122 in FIG. 9. In graphs 118 and 122 the used window is shown in dashed lines. The phase synthesizer is now arranged to provide a continuous phase at the position where the overlap has its largest impact. With the window function used here this position is at sample 119. For the phase $\phi_k[i]$ of the current frame can now be written:

$$\varphi_k[i] = \varphi_{k-1}[i] + i \cdot 2\pi \cdot f_{0,k-1}\frac{3N_s}{4} - i \cdot 2\pi \cdot f_{0,k}\frac{N_s}{4}; 1 \le i \le 100 \quad (22)$$

In the currently described speech encoder the value of $N_s$ is equal to 160. For the very first voiced speech frame, the value of $\phi_k[i]$ is initialized to a predetermined value. The phases $\phi_k[i]$ are always updated, even if an unvoiced speech frame is received. In said case, $f_{0,k}$ is set to 50 Hz.

The harmonic oscillator bank 108 generates the plurality of harmonically related signals $\hat{s}'_{v,k}[n]$ that represents the speech signal. This calculation is performed using the harmonic amplitudes $\hat{m}[i]$, the frequency $\hat{f}_0$ and the synthesized phases $\hat{\phi}[i]$ according to:

$$\hat{s}'_{v,k}[n] = \sum_{i=1}^{L} \hat{m}[i]\cos\{(i \cdot 2\pi \cdot f_0) \cdot n + \hat{\varphi}[i]\}; 0 \le n < N_s \quad (23)$$

The signal $\hat{s}'_{v,k}[n]$ is windowed using a Hanning window in the Time Domain Windowing block 114. This windowed signal is shown in graph 120 of FIG. 9. The signal $\hat{s}'_{v,k+1}[n]$ is windowed using a Hanning window being $N_s/2$ samples shifted in time. This windowed signal is shown in graph 124 of FIG. 9. The output signals of the Time Domain Windowing Block 144 is obtained by adding the above mentioned windowed signals. This output signal is shown in graph 126 of FIG. 9. A gain decoder 118 derives a gain value $g_v$ from its input signal, and the output signal of the Time Domain Windowing Block 114 is scaled by said gain factor $g_v$ by the Signal Scaling Block 116 in order to obtain the reconstructed voiced speech signal $\hat{s}_{v,k}$.

In the unvoiced speech synthesizer 96, the LPC codes and the voiced/unvoiced flag are applied to an LPC Decoder 130.

The LPC decoder 130 provides a plurality of 6 a-parameters to an LPC Synthesis filter 134. An output of a Gaussian White-Noise Generator 132 is connected to an input of the LPC synthesis filter 143. The output signal of the LPC synthesis filter 134 is windowed by a Hanning window in the Time Domain Windowing Block 140.

An Unvoiced Gain Decoder 136 derives a gain value $\hat{g}_{uv}$ representing the desired energy of the present unvoiced frame. From this gain and the energy of the windowed signal, a scaling factor $\hat{g}'_{uv}$ for the windowed speech signal gain is determined in order to obtain a speech signal with the correct energy. For this scaling factor can be written:

$$\hat{g}'_{uv} = \sqrt{\frac{\hat{g}_{uv}}{\sum_{n=0}^{N_s-1} (\hat{s}'_{uv,k}[n] \cdot w[n])^2}} \tag{24}$$

The Signal Scaling Block 142 determines the output signal ŝuv,kby multiplying the output signal of the time domain window block 140 by the scaling factor $\hat{g}'_{uv}$.

The presently described speech encoding system can be modified to require a lower bitrate or a higher speech quality. An example of a speech encoding system requiring a lower bitrate is a 2 kbit/sec encoding system. Such a system can be obtained by reducing the number of prediction coefficients used for voiced speech from 16 to 12, and by using differential encoding of the prediction coefficients, the gain and the refined pitch. Differential coding means that the date to be encoded is not encoded individually, but that only the difference between corresponding data from subsequent frames is transmitted. At a transition from voiced to unvoiced speech or vice versa, in the first new frame all coefficients are encoded individually in order to provide a starting value for the decoding.

It is also possible to obtain a speech coder with an increased speech quality at a bit rate of 6 kbit/s. The modifications are here the determination of the phase of the first 8 harmonics of the plurality of harmonically related sinusoidal signals. The phase φ[i] is calculated according to:

$$\varphi[i] = \arctan\frac{I(\theta_i)}{R(\theta_i)} \tag{25}$$

Herein is $\theta_i = 2\pi f_0 \cdot i$. $R(\theta_i)$en $I(\theta_i)$ are equal to:

$$R(\theta_i) = \sum_{n=0}^{N-1} s_w[n] \cdot \cos(\theta_i \cdot n) \tag{26}$$

and $$I(\theta_i) = -\sum_{n=0}^{N-1} s_w[n] \cdot \sin(\theta_i \cdot n) \tag{27}$$

The 8 phases φ[i] obtained so are uniformly quantised to 6 bits and included in the output bitstream.

A further modification in the 6 kbit/sec encoder is the transmission of additional gain values in the unvoiced mode. Normally every 2 msec a gain is transmitted instead of once per frame. In the first frame directly after a transition, 10 gain values are transmitted, 5 of them representing the current unvoiced frame, and 5 of them representing the previous voiced frame that is processed by the unvoiced speech encoder. The gains are determined from 4 msec overlapping windows.

It is observed that the number of LPC coefficients is 12 and that where possible differential encoding is utilized.

What is claimed is:

1. Transmission system which includes a transmitter comprising a speech encoder having analysis means for periodically determining analysis coefficients of a digitized speech signal representing successive speech segments, each segment including a plurality of samples of the speech signal, the transmitter further comprising transmit means for transmitting said analysis coefficients via a transmission medium to a receiver, said receiver comprising a speech decoder having reconstruction means for deriving a reconstructed speech signal on the basis of the analysis coefficients; characterized in that the analysis means are arranged for determining the analysis coefficients more frequently in the vicinity of the transition between a voiced speech segment and an unvoiced speech segment, and in that the reconstruction means are arranged for deriving a reconstructed speech signal on the basis of the more frequently determined analysis coefficients.

2. Transmission system according to claim 1, characterized in that the speech encoder comprises a voiced speech encoder for encoding voiced speech segments and an unvoiced speech encoder for encoding unvoiced speech segments.

3. Transmission system according to claim 1, characterized in that the analysis means are arranged for determining analysis coefficients more frequently during every two speech segments immediately subsequent to a transition between voiced and unvoiced speech segments.

4. Transmission system according to claim 1, characterized in that the analysis means are arranged for doubling the frequency of determination of the analysis coefficients at a transition between a voiced and unvoiced segment of said signal.

5. Transmission system according to claim 4, characterized in that the analysis means are arranged for determining the analysis coefficients every 20 msec if no transition takes place, and every 10 msec in the vicinity of a transition if a transition does take place.

6. Receiver for receiving an encoded speech signal comprising a plurality of analysis coefficients, said receiver including a speech decoder comprising reconstruction means for deriving a reconstructed speech signal on the basis of analysis coefficients extracted from the received signal; characterized in that the reconstruction means are adapted to extract the analysis coefficients more frequently in the vicinity of a transition between a voiced speech signal and an unvoiced speech signal, and to derive a reconstructed speech signal on the basis of the more frequently available analysis coefficients.

7. Speech decoding method for decoding an encoded speech signal comprising a plurality of analysis coefficients, said method comprising deriving a reconstructed speech signal on the basis of analysis coefficients extracted from the received signal; characterized in that the analysis coefficients are extracted more frequently in the vicinity of a transition between a voiced speech segment and an unvoiced speech segment, and in that derivation of the reconstructed speech signal is performed on the basis of the more frequently available analysis coefficients.

8. Encoded speech signal comprising a plurality of analysis coefficients periodically introduced in the encoded speech signal, characterized in that the encoded speech signal carries the analysis coefficients more frequent near a transition between a voiced speech segment and an unvoiced speech segment or vice versa.

9. A tangible storage medium storing a computer program for executing a speech encoding method comprising periodically determining analysis coefficients of a digitized speech signal representing successive speech segments, each segment including a plurality of samples of the speech signal, characterized in that said encoding method comprises determining the analysis coefficients more frequently in the vicinity of a transition between a voiced speech segment and an unvoiced speech segment.

10. A tangible storage medium storing a computer program for executing a speech decoding method for decoding an encoded speech signal having a plurality of analysis coefficients, said method comprising deriving a reconstructed speech signal on the basis of analysis coefficients extracted from the received signal; characterized in that the analysis coefficients are extracted more frequently in the vicinity of a transition between a voiced speech segment and an unvoiced speech segment, and derivation of the reconstructed speech signal is performed on the basis of the more frequently available analysis coefficients.

11. Transmitter including a speech encoder which comprises analysis means for periodically determining analysis coefficients of a digitized speech signal representing successive speech segments, each segment including a plurality of samples of the speech signal; said transmitter comprising transmit means for transmitting said analysis coefficients; characterized in that the analysis means are adapted to determine the analysis coefficients more frequently in the vicinity of a transition between a voiced speech segment and an unvoiced speech segment of the speech signal.

12. Speech encoding method for periodically determining analysis coefficients of a digitized speech signal representing successive speech segments, each segment including a plurality of samples of the speech signal; characterized in that the analysis coefficients are determined more frequently in the vicinity of a transition between a voiced segment and an unvoiced segment of the speech signal.

* * * * *